US005685534A

United States Patent [19]

Zeltner

[11] Patent Number: 5,685,534

[45] Date of Patent: Nov. 11, 1997

[54] METHOD AND DEVICE FOR CONTROLLING VALVE UNITS

[75] Inventor: Jürgen Zeltner, Hirschberg, Germany

[73] Assignee: Heidelberger Druckmaschinen AG, Heidelberg, Germany

[21] Appl. No.: 627,777

[22] Filed: Apr. 1, 1996

[30] Foreign Application Priority Data

Apr. 1, 1995 [DE] Germany ..... 195 12 313.1

[51] Int. Cl.[6] ..... B65H 3/08

[52] U.S. Cl. ..... 271/108; 271/98; 271/105; 251/129.13; 251/294

[58] Field of Search ..... 271/96, 108, 11, 271/98, 105; 251/129.13, 294

[56] References Cited

U.S. PATENT DOCUMENTS 3,069,025 12/1962 Winkler et al. ..... 271/96 X
3,761,077 9/1973 Vollrath et al. ..... 271/108
4,162,066 7/1979 McCain et al. ..... 271/96 X
5,480,137 1/1996 Haupenthal ..... 271/108 X

FOREIGN PATENT DOCUMENTS 38 42 390 6/1990 Germany .
64935 3/1989 Japan ..... 271/108

*Primary Examiner*—Boris Milef
*Attorney, Agent, or Firm*—Herbert L. Lerner; Laurence A. Greenberg

[57] ABSTRACT

Method for controlling a valve unit having a rotatable inner part, by which at least one of positive pressure and negative-pressure consumers of a sheet-processing machine is connectible to and disconnectible from a source of positive pressure and negative pressure, respectively, in accordance with an operating cycle of the sheet-processing machine, the operating cycle being repeated at a frequency variable between a minimum cycle frequency and a maximum cycle frequency, includes superimposing an adjusting speed on a rotary speed of the rotatable inner part of the valve unit; and device for performing the method.

12 Claims, 4 Drawing Sheets

METHOD AND DEVICE FOR CONTROLLING VALVE UNITS

BACKGROUND OF THE INVENTION

1. Field of the Invention

The invention relates to a method and a device for controlling valve units, by which positive pressure and/or negative-pressure consumers of a sheet-processing machine are connectible to or disconnectible from a source of positive pressure and/or negative pressure in accordance with the operating cycle of the sheet-processing machine, the frequency of the operating cycles being variable between a minimum cycle frequency and a maximum cycle frequency.

Such a method and a corresponding device have become known heretofore from the published German Patent Document DE 38 42 390 A1. In such control devices, for example, pick-up or separator suckers, forwarding or pull suckers, as well as other consumers of positive pressure and/or negative pressure are acted upon by positive pressure or negative pressure, respectively, during specific portions of the operating cycle of the sheet-processing machine, in order, for example, to engage or grasp sheets and feed or convey them onward.

Because the pressure buildup and pressure reduction, respectively, at the consumers require a given amount of time, and the source of positive pressure and negative pressure, respectively, feeds such pressure at constant output, a delay occurs in the response of the consumers which are thus acted upon, in comparison with the respective portion of the operating cycle, when the cycle frequency of the operating cycle increases. This leads to an incorrect sheet processing deviating from the operating cycle, an example of which being delayed sheet feeding. Delayed sheet feeding, however, can mean that the sheets are no longer correctly supplied to a device, such as a printing press, for further processing.

To change the phase relationship of the air control times for a varying machine speed, an external part of a rotary valve is swiveled in the construction disclosed in the published German Patent Document DE 38 42 390 A1. This measure proves disadvantageous, however, in that supply and extraction lines for suction and/or blast air, which are disposed on the external part, must be swiveled along therewith.

SUMMARY OF THE INVENTION

It is accordingly an object of the invention to provide a method for controlling valve units and a device for performing the method by means of which a cyclically precise control of the suction and/or blast air is assured.

With the foregoing and other objects in view, there is provided, in accordance with one aspect of the invention, a method for controlling a valve unit having a rotatable inner part, by which at least one of positive pressure and negative-pressure consumers of a sheet-processing machine is connectible to and disconnectible from a source of positive pressure and negative pressure, respectively, in accordance with an operating cycle of the sheet-processing machine, the operating cycle being repeated at a frequency variable between a minimum cycle frequency and a maximum cycle frequency, which comprises superimposing an adjusting speed on a rotary speed of the rotatable inner part of the valve unit.

In accordance with a another mode of the invention, the method includes superimposing the adjusting speed on the rotary speed of the inner part until such time as a desired phase adjustment is attained.

In accordance with a further mode of the method according to the invention, the phase adjustment has a magnitude depending upon the machine speed.

In accordance with another aspect of the invention, there is provided a device for controlling a valve unit having a rotatable inner part, by which at least one of positive pressure and negative-pressure consumers of a sheet-processing machine is respectively connectible to and disconnectible from a source of positive pressure and negative pressure, respectively, in accordance with an operating cycle of the sheet-processing machine, the operating cycle being repeatable at a frequency variable between a minimum cycle frequency and a maximum cycle frequency, comprising a mechanism for superimposing a further speed on a rotary speed of the inner part which is dependent upon the machine speed.

In accordance with another feature of the invention, the controlling device includes a chain or toothed belt drive for driving the inner part at the machine speed, the chain or toothed belt drive having a taut side and a slack side, the taut side being deflectable for effecting a phase adjustment of the inner part.

In accordance with a further feature of the invention, the controlling device includes an adjusting roller engaging the taut side.

In accordance with an added feature of the invention, the controlling device includes an adjusting device for varying the location of the adjusting roller.

In accordance with an additional feature of the invention, the controlling device includes a tension roller in engagement with the slack side, the tension roller having a force of a force-storing device acting thereon.

In accordance with yet another feature of the invention, the inner part has a shaft butt, and a superposition gear transmission is disposed on the shaft butt.

In accordance with yet a further feature of the invention, the superposition gear transmission is a planetary gear system.

In accordance with yet an added feature of the invention, the planetary gear system includes a sun gear disposed so as to be rotatable by a control motor for effecting a phase adjustment.

In accordance with a concomitant feature of the invention, the outer part of the valve unit is rigidly disposed.

An advantage of the device according to the invention is that the outer part of the rotary valve is stationary. Due to this construction, only small installation spaces need be provided for the required supply and extraction lines, and it is possible to minimize the wear on the supply and extraction lines.

It is also possible to lay the supply and extraction lines between the rotary valve and the associated consumers along the shortest path, while maintaining the most favorable bending radii.

In an advantageous construction, an adjusting roller is rotatably supported on a swivelable lever for deflecting a chain or toothed belt drive, the drive or taut side thereof being engaged by the adjusting roller. A spring-loaded tension roller compensates for the adjusting path on the slack side.

In an advantageous alternative to the preferred embodiment, a superposition gear transmission, such as a planetary gear system, is provided.

Other features which are considered as characteristic for the invention are set forth in the appended claims.

Although the invention is illustrated and described herein as a method and device for controlling valve units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
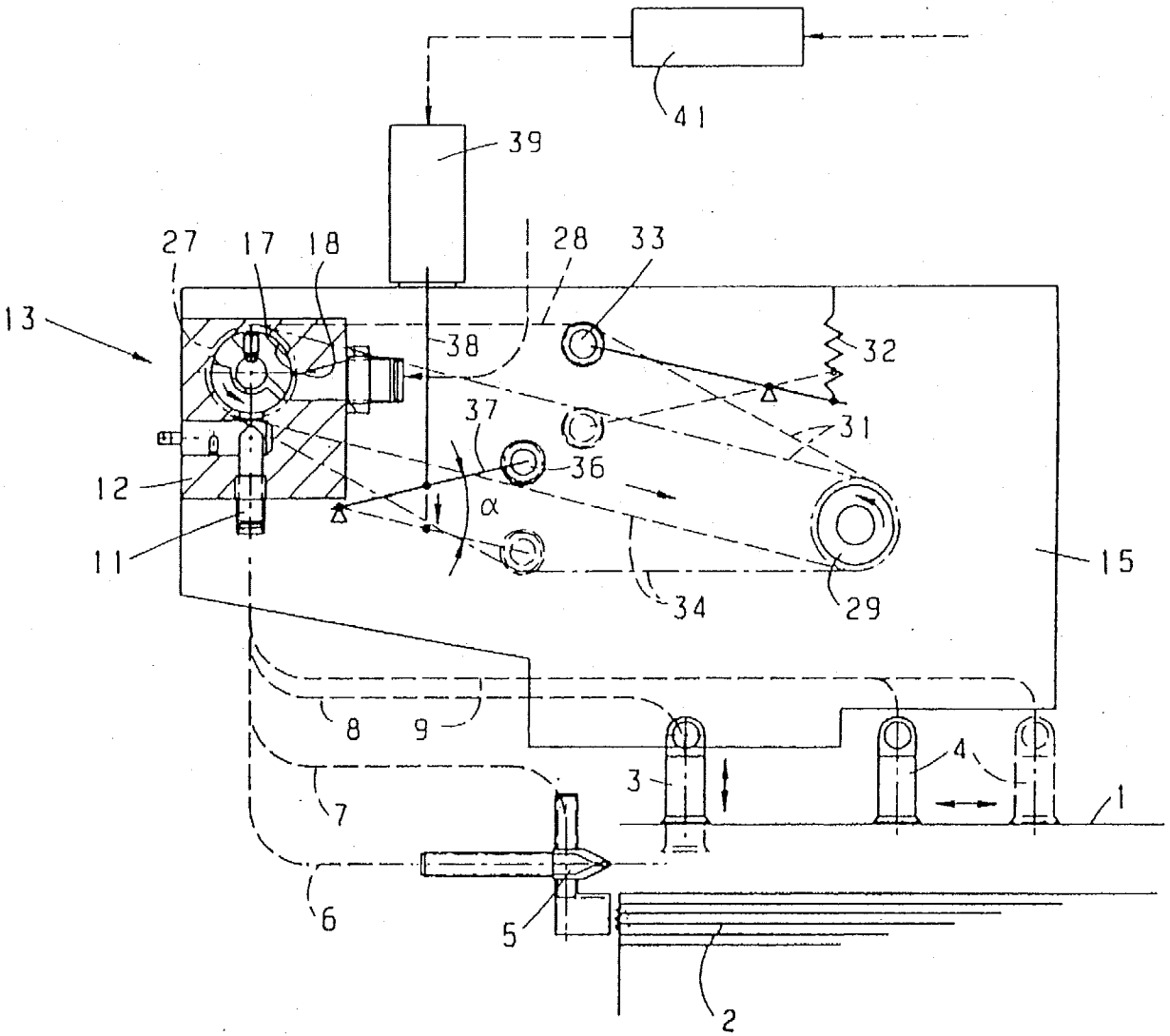
FIG. 1 is a diagrammatic and schematic side elevational view of a suction head on a feeder of a sheet-fed rotary printing press.

Referring now to the drawings and, first, particularly to FIG. 1 thereof, there are shown therein a number of positive pressure and/or negative pressure consumers for transporting sheets of paper 1 taken from a sheet pile 2 and fed to a sheet-fed rotary printing press. They are, by way of example, lifting suckers 3, forwarding or pull suckers 4, or fanning blowers 5 directed towards a side of the sheet pile 2, all disposed above the sheet pile 2. These positive pressure and/or negative pressure consumers are connected to pipe connections 11 by means of lines which supply and/or discharge or extract positive pressure and/or negative pressure, such as hoses 6, 7, 8 and 9, for example. The pipe connections 11 are screwed into a stationary outer part 12, such as a housing, for example, of a rotary valve 13. The rotary valve 13 is flanged to a housing of a suction head 15.

A cylindrical inner part 17 is mounted so as to be rotatable without contact in a bore 18 formed in the outer part 12.

Figure 2:
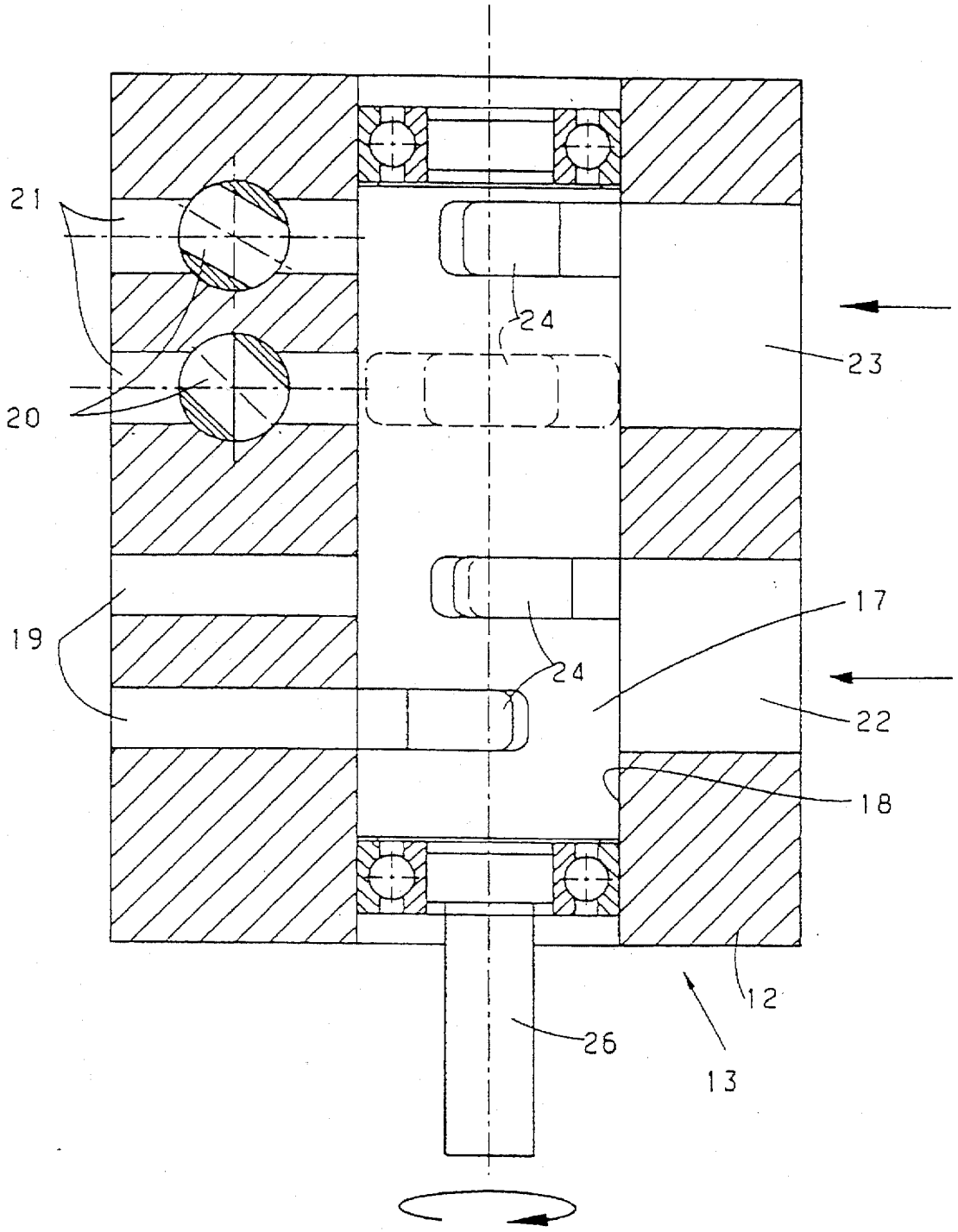
FIG. 2 is an enlarged fragmentary sectional view of FIG. 1, showing a rotary valve thereof.

As shown in FIG. 2, the outer part 12 is formed at the circumference thereof with outlets 19 and 21 and inlets 22 and 23 which, by means of control recesses 24 formed in the inner part 17, during a given setting or position of the inner part 17 and the outer part 12 relative to one another, place the mutually associated inlets 22 and 23 and outlets 19 and 21 into communication with one another. The inlets 22 and 23 communicate with a non-illustrated source of positive pressure and negative pressure, respectively. To adjust the quantity of blast air, adjustable throttle valves 20 are disposed in the outlets 21. A drive gear 27 (FIG. 1) is disposed on a shaft butt or trunnion 26 of the inner part 17. The drive gear 27 is driven at the speed of a non-illustrated sheet-processing machine by means of an endlessly revolving chain or toothed belt drive 28. The drive 28 of the chain or toothed belt is effected by a gear wheel 29. A return strand or slack side 31 of the toothed belt or chain 28 is tautened by means of a tension roller 33 loaded by a spring 32. An adjusting roller 36 engages the drive strand or taut side 34 of the toothed belt or chain 28. The adjusting roller 36 is rotatably supported at one end of a swivelably disposed lever 37. An adjusting element 38 articulatingly engages the lever 37. The adjusting element 38 may be, for example, a threaded rod movable in the axial direction and driven by a control drive 39, or a piston rod or the like.

Figure 4:
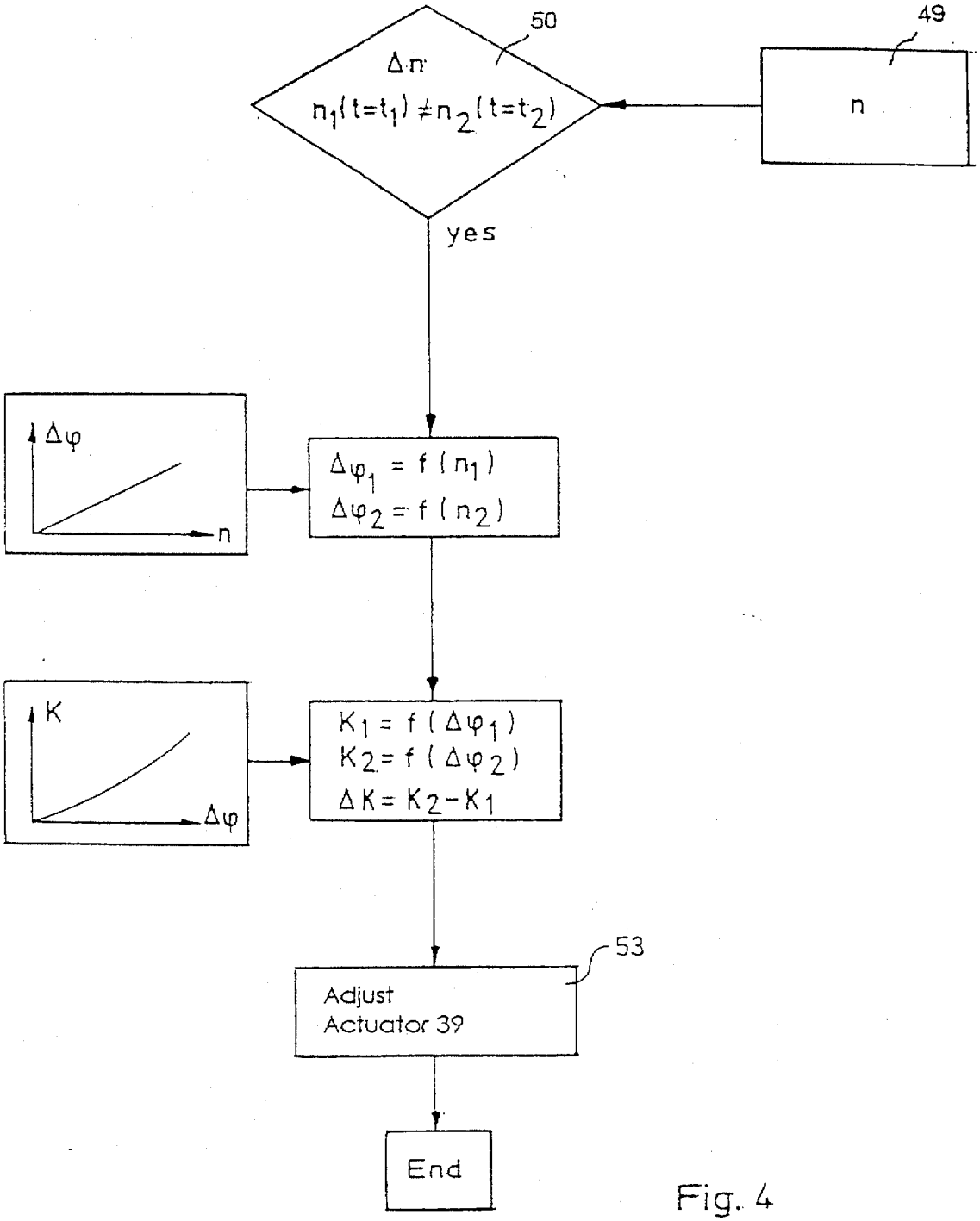
FIG. 4 is a flow chart for determining an adjustment value input used with the method and device according to the invention.

The control drive 39 is connected to a control computer 41. The speed or rpm of the sheet-processing machine serves as an input variable to the control computer 41. From this speed, the control computer 41 calculates the controlled variable for the control drive 39. As shown in the flow chart of FIG. 4, a change $\Delta$ in the speed n of the sheet-processing machine 49 is determined at 50. By suitable testing, the characteristic curves for the delay $\Delta\phi$ in the air control times to the theoretical or desired value, and the change $\Delta$ in the rotation K of the control drive 39 (the step-up or step-down thereof) for preadjusting to the delay are determined and fed into the computer 41 wherein they are applied to the calculation of the controlled variable. The actuator 39 is adjusted in accordance therewith at 53.

With increasing speed of the sheet-processing machine, a leading or advancing of the feed or supply of blast and suction air must be achieved. The adjusting drive 38 therefore swivels the lever 37 by means of the adjusting element 38 about an angle $\alpha$ as the machine speed increases. The adjusting roller 36 then engages the drive or taut side 34 and deflects it outwardly a given distance. Due to this measure, the path of the chain or toothed belt 28 between the gear wheels 29 and 27 is lengthened, and a second speed which persists during the adjusting movement is superimposed on the inner part 17 driven at machine speed, until a desired phase displacement of the inner part 17 relative to the machine cycle is attained.

The tension roller 33 balances out the lengthening of the path of the drive or taut side 34 by means of a corresponding shortening of the return strand or slack side 31.

The dot-dash line shows in phantom the chain or toothed belt 28 in a position or setting with a maximum advance of the inner part 17 or, in other words, the maximum speed of the sheet-processing machine.

If the machine speed is decreased, the lever 37 is swiveled back by the adjusting roller 36, and the path of the drive or taut side 34 is shortened, which slows down the rotary speed of the inner part 17 during the adjusting movement.

Figure 3:
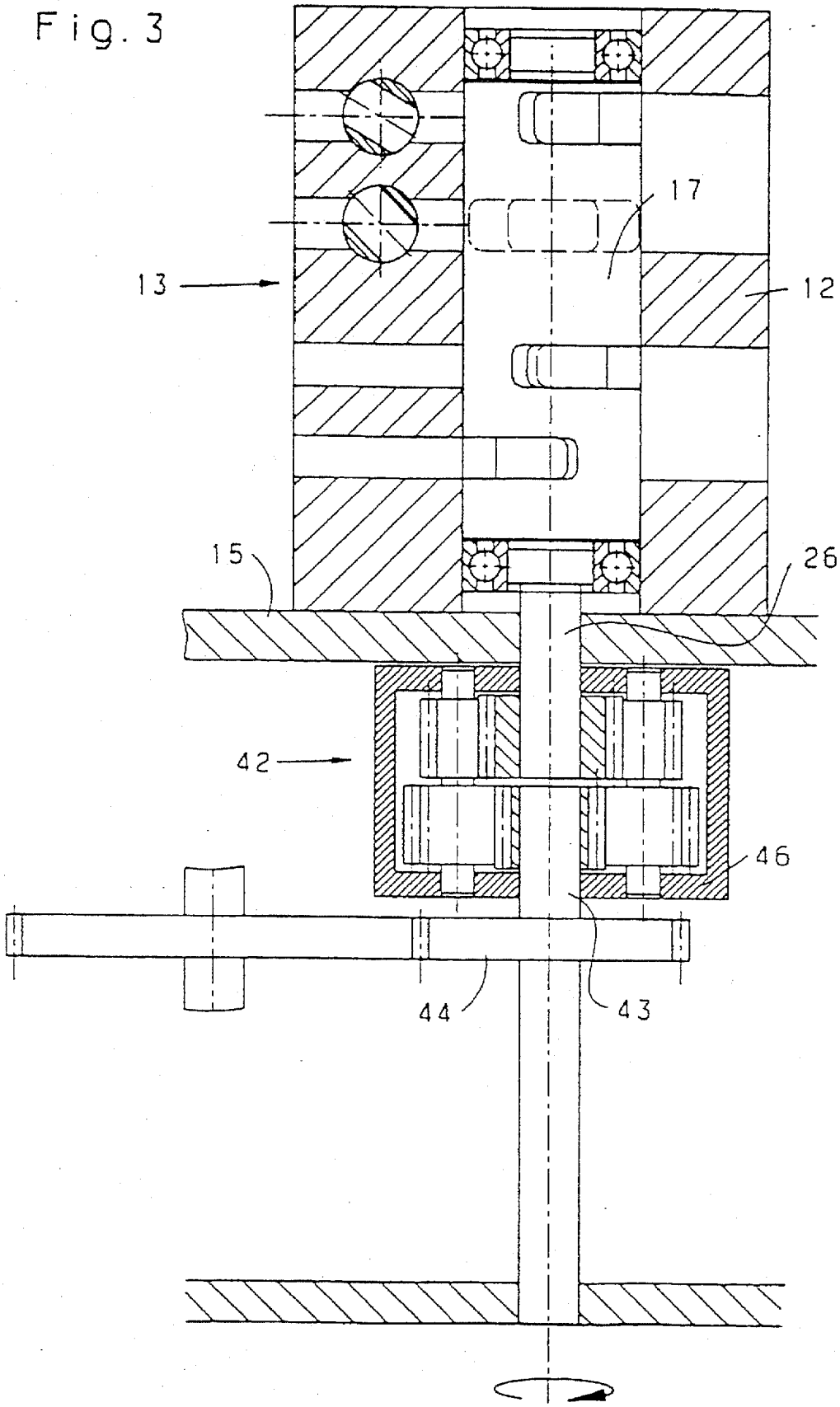
FIG. 3 is a reduced sectional view of the rotary valve of FIG. 2 in combination with a transmission system.

In a second embodiment of the invention shown in FIG. 3, the superposition of an adjusting speed on the machine speed is effected by means of the introduction of a superposed gear transmission, for example, in the form of a planetary gear system 42. The planetary gear system 42 is seated on the shaft butt or trunnion 26. The main drive of the planetary gear system 42 is effected by means of a shaft 43 which has a common axis with the shaft butt or trunnion 26, and is driven by the sheet-processing machine via a step-down or step-up gear transmission 44. The step-down or step-up of the planetary gear 42 is selected, respectively, as a function of the step-down or step-up gear transmission 44 so that the shaft butt 26 rotates at the speed of the sheet-processing machine. To adjust the advance (phase adjustment), the sun wheel 46 of the planetary gear transmission 42 is swiveled, for example, via a non-illustrated control motor or servomotor.

I claim:

1. Method for controlling a valve unit having a rotatable inner part, by which at least one of positive pressure and negative-pressure consumers of a sheet-processing machine is connectible to and disconnectible from a source of positive pressure and negative pressure, respectively, in accordance with an operating cycle of the sheet-processing machine, the operating cycle being repeated at a frequency variable between a minimum cycle frequency and a maximum cycle frequency, which comprises driving the rotatable inner part of the valve unit at a given rotary speed and superimposing an adjusting speed directly on the given rotary speed.

2. Method according to claim 1, which includes superimposing the adjusting speed on the rotary speed of the inner part until such time as a desired phase adjustment is attained.

3. Method according to claim 2, wherein the phase adjustment has a magnitude depending upon the machine speed.

4. Device for controlling a valve unit having a rotatable inner part, by which at least one of positive pressure and negative-pressure consumers of a sheet-processing machine is respectively connectible to and disconnectible from a source of positive pressure and negative pressure, respectively, in accordance with an operating cycle of the sheet-processing machine, the operating cycle being repeatable at a frequency variable between a minimum cycle frequency and a maximum cycle frequency, comprising a mechanism for superimposing a further speed on a given rotary speed of the inner part which is dependent upon the machine speed.

5. Controlling device according to claim 4, including a chain or toothed belt drive for driving the inner part at the machine speed, said chain or toothed belt drive having a taut side and a slack side, said taut side being deflectable for effecting a phase adjustment of the inner part.

6. Controlling device according to claim 5, including an adjusting roller engaging said taut side.

7. Controlling device according to claim 6, including an adjusting device for varying the location of said adjusting roller.

8. Controlling device according to claim 5, including a tension roller in engagement with said slack side, and a force-storing device defining a force acting on said tension roller.

9. Controlling device according to claim 4, wherein the inner part has a shaft butt, and including a superposition gear transmission disposed on said shaft butt.

10. Controlling device according to claim 9, wherein said superposition gear transmission is a planetary gear system.

11. Controlling device according to claim 10, wherein said planetary gear system includes a sun gear disposed so as to be rotatable by a control motor for effecting a phase adjustment.

12. In combination with a sheet-processing machine with at least one of positive pressure and negative pressure consumers, a source of positive pressure and negative pressure, a device for controlling a valve unit having a rotatable inner part and a rigidly disposed outer part, by which the at least one of positive pressure and negative-pressure consumers of the sheet-processing machine is respectively connectible to and disconnectible from the source of positive pressure and negative pressure, respectively, in accordance with an operating cycle of the sheet-processing machine, the operating cycle being repeatable at a frequency variable between a minimum cycle frequency and a maximum cycle frequency, comprising a mechanism for superimposing a further speed on a rotary speed of the inner part which is dependent upon the machine speed.

* * * * *